US006527492B1

(12) United States Patent
Kerns, III et al.

(10) Patent No.: US 6,527,492 B1
(45) Date of Patent: Mar. 4, 2003

(54) APPARATUS FOR HANDLING, LIFTING AND SUPPORTING CONSTRUCTION PANELS

(76) Inventors: Chester A. Kerns, III, 13917 Stillwell Rd., Bonner Springs, KS (US) 66012-9528; Travis P. Kerns, 1317 Stillwell Rd., Bonner Springs, KS (US) 66012-9528

( * ) Notice: Subject to any disclaimer, the term of this patent is extended or adjusted under 35 U.S.C. 154(b) by 0 days.

(21) Appl. No.: 10/055,463

(22) Filed: Jan. 25, 2002

(51) Int. Cl.[7] ..... E04G 21/16

(52) U.S. Cl. ..... 414/11; 248/159; 248/411; 248/413

(58) Field of Search ..... 248/159, 411, 248/413; 414/11

(56) References Cited

U.S. PATENT DOCUMENTS

| | | | | | |
|---|---|---|---|---|---|
| 2,903,227 | A | | 9/1959 | Key | 248/200.1 |
| 3,280,527 | A | | 10/1966 | Faust | 248/200.1 X |
| 4,064,999 | A | * | 12/1977 | Young | 414/11 |
| 4,375,934 | A | | 3/1983 | Elliott | 414/11 |
| 4,491,449 | A | * | 1/1985 | Hawkins | 414/10 |
| 4,733,844 | A | | 3/1988 | Molloy | 248/354.1 |
| 5,086,930 | A | | 2/1992 | Saeks | 211/17 |
| 5,129,774 | A | | 7/1992 | Balseiro et al. | 414/11 |
| 5,944,468 | A | * | 8/1999 | McBrien | 414/11 |

* cited by examiner

*Primary Examiner*—Janice L. Krizek
(74) *Attorney, Agent, or Firm*—Donald R. Schoonover

(57) ABSTRACT

An apparatus for handling, lifting and supporting construction panels such as sheet rock or the like includes a pole unit that has telescoping poles supported on a scaffolding unit by supports that are quickly and easily attached and detached from the scaffolding unit. A workpiece engaging element is rotatably mounted on the poles.

7 Claims, 4 Drawing Sheets

APPARATUS FOR HANDLING, LIFTING AND SUPPORTING CONSTRUCTION PANELS

BACKGROUND OF THE INVENTION

1. Field of the Invention

The present invention relates to material or article handling and more particularly to wall or ceiling member manipulating apparatus, alternatively, this invention relates to the general art of supports.

2. Discussion of the Related Art

Drywall and other forms of interior surface finishing panels used in the building industry are traditionally applied to ceiling and wall framing by placing planar sheets against the framing and securing each sheet in place by nailing, screwing, adhesive bonding or by a combination of fastening techniques to achieve permanent installation of adjacent panels or sheets. Because of the size and weight of such construction materials, the installation procedure often requires at least two persons, particularly where each sheet must be retained in an elevated position while fasteners are installed. Also, it is usually necessary that one or both of the two persons manually retain the sheet in position with one hand while inserting the fastener elements with the other hand. The installation is further complicated by the requirement in many cases that both persons use step ladders, scaffolding or other form of movable platform in order to reach the sheet in it ultimate position.

Accordingly, the art contains several inventions for facilitating installation of such materials. While somewhat effective, the devices embodying these inventions are often bulky, difficult to set up, difficult to knock down, expensive and inconvenient.

Therefore, there is a need for an apparatus for handling and supporting construction materials, such as drywall or the like, that is easy to use and is also easy to set up and to knock down.

Still further, some panels are more bulky than others and some panel installations are more precarious than others. Thus, some mechanism should be available for making a device used to handle such panels more stable in some situations. However, this should not be done by simply making the apparatus as bulky as possible so it can handle all situations. This approach would make the apparatus too bulky for some situations thereby making the apparatus too costly for most situations.

Therefore, there is a need for an apparatus for handling and supporting construction materials that is versatile and can be made stable enough for each particular situation.

Of course, the modification of such an apparatus should not require a great deal of work which would vitiate the advantages associated with the versatility of the apparatus.

Therefore, there is a need for an apparatus for handling and supporting construction materials that is versatile and can quickly and easily be made stable enough for each particular situation.

PRINCIPAL OBJECTS OF THE INVENTION

It is a main object of the present invention to provide an apparatus for handling and supporting construction materials.

It is another object of the present invention to provide an apparatus for handling and supporting construction materials such as drywall or the like.

It is another object of the present invention to provide an apparatus for handling and supporting construction materials such as drywall or the like that is used in the ceiling of a building.

It is another object of the present invention to provide an apparatus for handling and supporting construction materials such as drywall or the like that is used in the ceiling of a building that is easy to use and is also easy to set up and to knock down.

It is another object of the present invention to provide an apparatus for handling and supporting construction materials that is versatile and can be made stable enough for each particular situation.

It is another object of the present invention to provide an apparatus for handling and supporting construction materials that is versatile and can quickly and easily be made stable enough for each particular situation.

SUMMARY OF THE INVENTION

These, and other, objects are achieved by an apparatus for handling, lifting and supporting construction panels which comprises a pole unit which includes a plurality of telescopingly engaged poles; a quick-release lock coupling two of the poles of the pole unit together when in a locking configuration; a pole unit mounting unit fixedly mounted on one pole of the pole unit and including two scaffolding-engaging brackets having U-shaped bodies which releasably engage elements of a scaffolding unit; a workpiece-engaging unit rotatably mounted on a second pole of the pole unit; and a lock element locking the workpiece-engaging unit to the second pole of the pole unit when in a locked configuration.

The U-shaped bodies of the pole mounting unit are easily attached to elements of a scaffolding for a quick and easy set up, and are easily detached from the scaffolding for a quick and easy knockdown. The workpiece-engaging unit is rotatable so it can assume the most effective orientation with respect to the workpiece, and can be removed and replaced with a workpiece-engaging element that is most effective for a particular job. For example, the same apparatus can be used to install drywall and to install conduits. This makes the apparatus versatile and thus cost effective.

Additional support locations can be easily and quickly added to the apparatus so the apparatus can be modified to be more stable in an easy and rapid manner.

DETAILED DESCRIPTION OF THE INVENTION

Other objects, features and advantages of the invention will become apparent from a consideration of the following detailed description and the accompanying drawings.

The apparatus embodying the present invention is easily attached to a scaffolding that is being used to elevate workers into position to manipulate drywall or the like into a ceiling of a building. The apparatus is easily attached to and detached from the scaffolding and is easily adjusted to the desired height. The apparatus can also be used to install other overhead elements, such as pipes, conduits or the like into position, including an overhead position.

Figure 1:
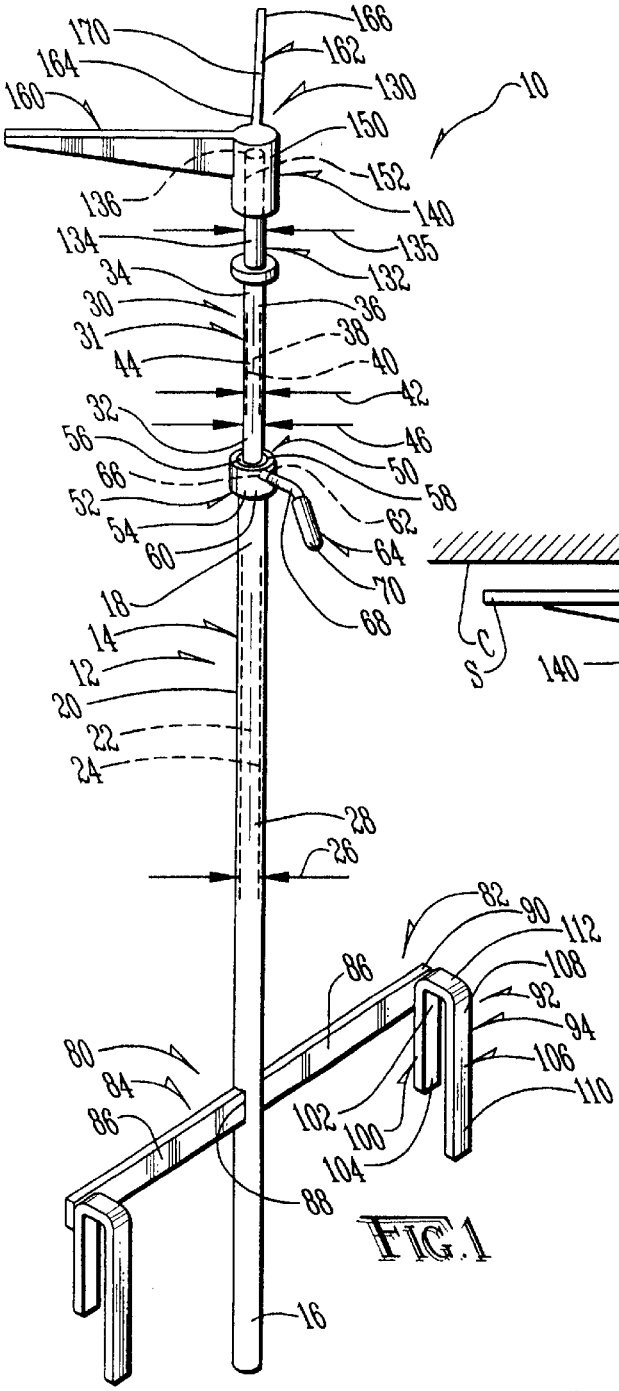
FIG. 1 is a perspective view of a first form of the apparatus embodying the present invention.
Figure 2:
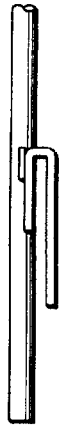
FIG. 2 is a view of a scaffolding engaging section of the apparatus of the present invention.
Figure 5:
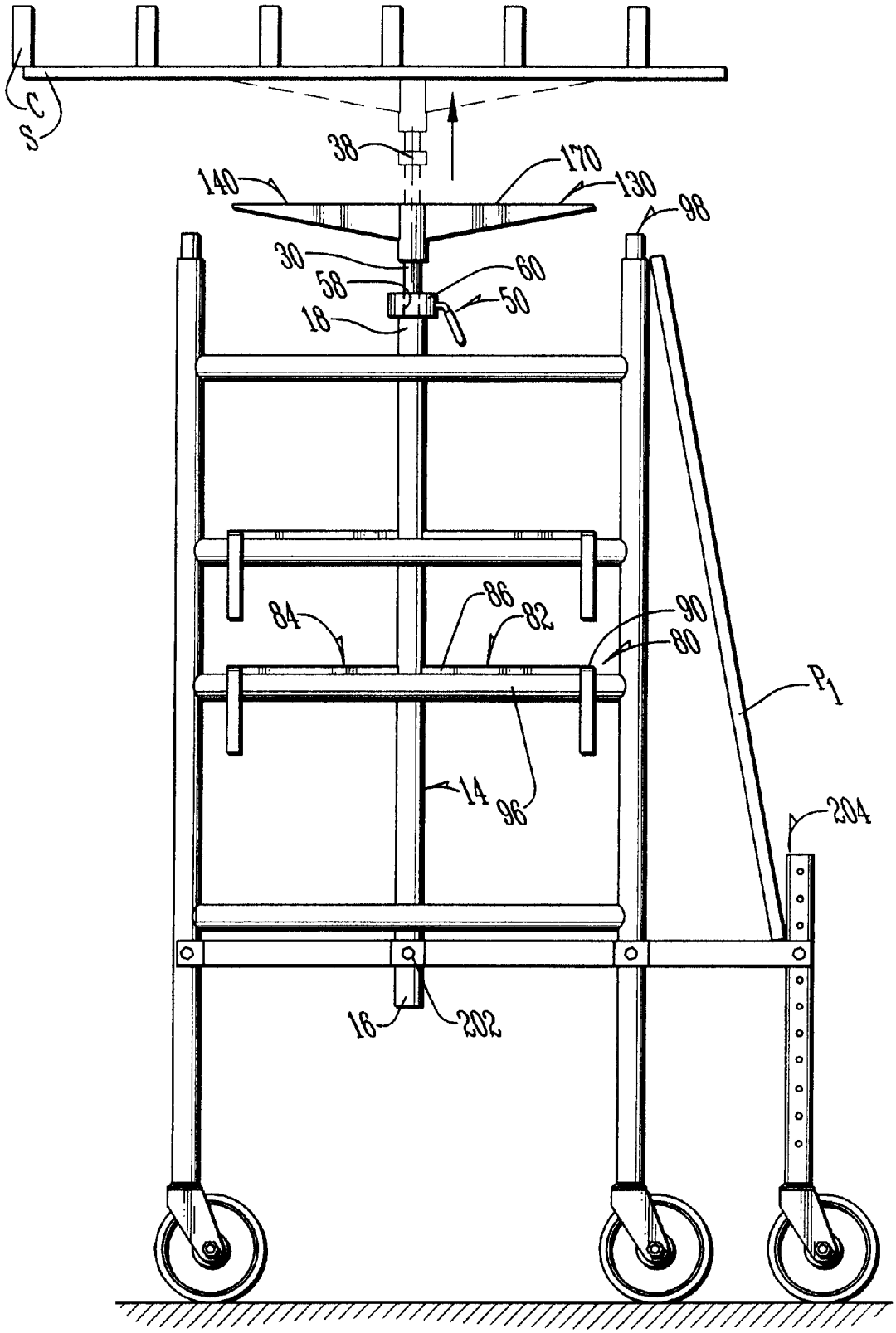
FIG. 5 is a side elevational view of the apparatus of the present invention mounted on a scaffolding unit with a workpiece-holding unit also mounted on the scaffolding unit.

Shown in FIGS. 1–5 is an apparatus 10 for handling, lifting and supporting construction panels, such as drywall panels S or the like adjacent to an overhead work area, such as ceiling C. More specifically, apparatus 10 comprises a pole unit 12 which includes a base pole section 14 having a proximal end 16, a distal end 18, a cylindrical hollow body 20, a longitudinal axis 22 extending between proximal end 16 and distal end 18 of base pole section 14. A bore 24 is defined along longitudinal axis 22 from distal end 18 to proximal end 16 of base pole section 12, and for the sake of clarity is indicated only in FIG. 1. Bore 24 of body 20 of base pole section 14 has an inner dimension 26. Body 20 further includes an outer surface 28. Pole unit 12 includes a plurality of pole sections, including a second pole section 30 having a hollow cylindrical body 31 having proximal end 32, a distal end 34, a cylindrical hollow body 36, a longitudinal axis 38 extending between proximal end 32 of the second pole section 30 of pole unit 12 and distal end 34 of the second pole section 30 of pole unit 12, and a bore 40 defined along longitudinal axis 38 of body of second pole section 30 between proximal end 32 of the second pole section 30 of pole unit 12 and distal end 34 of second pole section 30 of the pole unit 12. Bore 40 of body 31 of the second pole section 30 of the pole unit has an inner dimension 42 and an outer surface 44 with an outer dimension 46. Outer dimension 46 of second pole section 30 of pole unit 12 is smaller than inner dimension 26 of bore 24 of body 20 of base pole section 14 of pole unit 12. In a set-up configuration such as shown in FIGS. 1 and 5, second pole section 30 of pole unit 14 is telescopingly received in bore 24 of body 20 of base pole section 14 of pole unit 12 with proximal end 32 of body 31 of second pole section 30 of pole unit 12 located in bore 24 of body 20 of base pole section 14 of pole unit 12 and distal end 34 of body 31 of second pole section 30 of pole unit 12 spaced from distal end 18 of body 20 of base pole section 14 of pole unit 12. The telescoping connection between the two pole sections 14 and 30 permits adjustment of the length of the pole unit 12 as indicated in FIG. 5. While two pole sections have been disclosed, those skilled in the art will understand that more than two pole sections can be used without departing from the scope of the present invention.

A quick-release lock 50 is positioned on body 20 of base pole section 14 of pole unit 12 adjacent to distal end 18 of body 20 for releasably coupling second pole section 30 to base pole section 14. Quick-release lock 50 includes a sleeve 52 having a first section 54 fixed to outer surface 28 of body 20 of base pole section 14 of pole unit 12, a second section 56 which is spaced from distal end 18 of body 20 of the base pole section 14 of the pole unit 12, an inside surface 58, and an outside surface 60. A threaded bore 62 is defined through sleeve 52 in second section 54 of the sleeve 52, and a threaded fastener 64 is threadably received in threaded bore 62. Threaded fastener 64 has a distal end 66 located adjacent to inside surface 58 of the second section 56 of the sleeve 52, and a proximal end 68 located adjacent to outside surface 28 of second section 56 of sleeve 52. A handle 70 is located on proximal end 68 of the threaded fastener 64 of quick-release lock 50. Threaded fastener 64 is movable in threaded bore 62 between a locking position with distal end 66 of the threaded fastener 64 engaging the outer surface of second pole section 30 which is received in bore 24 of body 20 of base pole section 14 of pole unit 12 in the set-up configuration and a releasing configuration with distal end 66 of the threaded fastener 64 spaced from the outer surface of the second pole section 30 of pole unit 12 received in the bore of the body of the base pole section 14 in the set-up configuration.

Apparatus 10 further includes a pole unit mounting section 80 which includes two scaffolding engaging sections 82 and 84 which are identical. Each scaffolding engaging section is mounted on base pole section 14 near proximal end 16 of body 20 of the base pole section 14 and includes a mounting element 86 having a proximal end 88 fixed to outer surface 28 of body 20 of base pole section 14 of pole unit 12, and a distal end 90. Each scaffolding engaging section 82 and 84 further includes a scaffolding engaging bracket 92 which includes a U-shaped body 94 which releasably engages an element 96 of a scaffolding unit 98 in the set-up configuration of apparatus 10. A first leg 100 of U-shaped body 94 has a first end 102 and a second end 104 and a length defined between first end 102 of the first leg 100 of the U-shaped body 94 of the scaffolding engaging bracket 92 and second end 104 of the first leg 100 of the U-shaped body 94 of the scaffolding engaging bracket 92. The scaffolding engaging bracket 92 further includes a second leg 106 which has a first end 108 and a second end 110 and a length defined between first end 108 of the second leg 106 of the U-shaped body 94 of the scaffolding engaging bracket 92 and second end 110 of the second leg 106 of the U-shaped body 94 of the scaffolding engaging bracket 92. The length of the second leg 106 of the U-shaped body 94 of the scaffolding engaging bracket 92 is longer than length of the first leg 100 of the U-shaped body 94 of the scaffolding engaging bracket 92. First end 102 of first leg 100 of the U-shaped body 94 of the scaffolding engaging bracket 92 is fixed to the mounting element 86 of the pole mounting section associated with the scaffolding engaging bracket 92 adjacent to the distal end of the mounting element 86 of the pole mounting section associated with the scaffolding engaging bracket 92. Each scaffolding engaging element further includes a bight section 112 connecting first end 102 of first leg 100 of the U-shaped body 94 of the scaffolding engaging bracket 92 to first end 108 of second leg 106 of the U-shaped body 94 of the scaffolding engaging bracket 92. The scaffolding engaging bracket 92 extends away from the mounting element 86 of the pole mounting section associated with the scaffolding engaging bracket 92.

Figure 3:
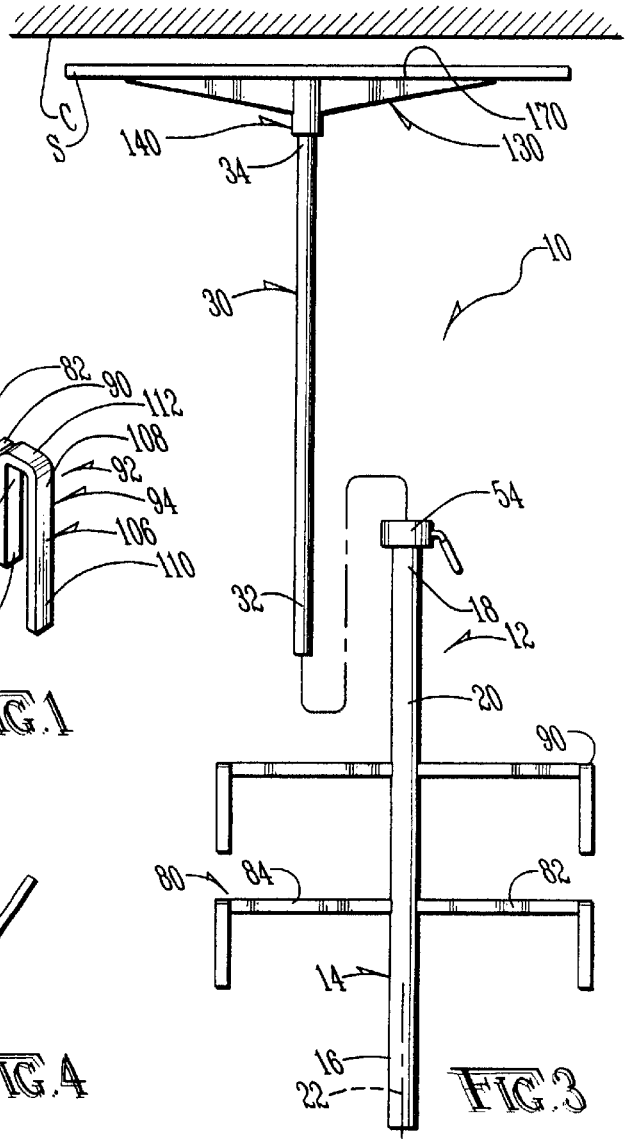
FIG. 3 is an exploded view of the apparatus of the present invention showing a second pole section removed from a base pole section of a pole unit.
Figure 4:
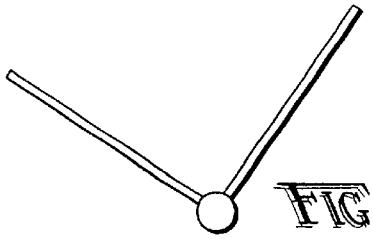
FIG. 4 is a top plan view of a workpiece-engaging unit of the apparatus of the present invention.

As can be seen in FIGS. 3 and 5, apparatus 10 can include a plurality of pole mounting sections. Additional pole mounting sections add stability to apparatus 10 and engage further scaffolding elements as shown in FIGS. 3 and 5. The ease with which the pole mounting sections are engaged with and disengaged from the scaffolding elements makes set up and knock down of apparatus 10 easy even if several pole mounting sections are used.

Apparatus 10 further includes a workpiece-engaging unit 130 which includes a support pole 132 having an outer surface 134 with an outer dimension 135 which is smaller than inner dimension 42 of bore 40 of body 31 of second pole section 30 of the pole unit. Support pole 132 of workpiece-engaging unit 130 has a distal end 136 spaced from distal end 34 of body 31 of second pole section 30 of the pole unit. A workpiece-engaging element 140 is fixed to distal end 136 of support pole 132 of workpiece-engaging unit 130 and includes a tubular sleeve 150 which has a blind-ended bore 152 defined therein. Support pole 132 of workpiece-engaging unit 130 is received in blind-ended bore 152 of tubular sleeve 150 of the workpiece-engaging element 140 and is fixedly secured to the tubular sleeve 150 adjacent to blind-ended bore 152. Support pole section of the workpiece-engaging unit 130 is rotatably received in bore 40 of the second pole section 30 adjacent to distal end 34 of the second pole section 30. The workpiece-engaging element 140 is rotatable in a plane that is at right angles to the plane containing longitudinal axis 38 of the second support pole section of the pole unit. The workpiece-engaging unit 130 further includes two workpiece-engaging legs 160 and 162 with each workpiece-engaging leg having a proximal end 164 fixed to the tubular sleeve 150 of the workpiece-engaging element 140 of workpiece engaging unit 130, and a distal end 166 spaced from the tubular sleeve 150 of the workpiece-engaging element 140 of workpiece engaging unit 130. The two workpiece-engaging legs are oriented at right angles with respect to each other.

Each workpiece-engaging leg includes a top edge 170 with the top edge of leg 160 being co-planar with the top edge of leg 162 to define a planar workpiece-engaging surface as indicated in FIGS. 3 and 5.

Different size workpiece engaging units can be used according to the size and bulk of a workpiece being used whereby the workpiece engaging unit can be selected to most efficiently carry out the objectives of the particular job. Since the workpiece engaging units can quickly and easily be changed, the exact workpiece required for a particular job can be selected and used.

Apparatus 10 further includes a lock element 180 positioned on distal end 34 of second pole section 30 of pole unit 12 and attaches support pole 132 of workpiece-engaging unit 130 to the second pole section of the pole unit in the set-up configuration. Lock element 180 is movable between a locked configuration locking the support pole of the workpiece-engaging unit 130 to the second pole section 30 of the pole unit 12 and an unlocked configuration in which the support pole of the workpiece-engaging unit 130 is rotatable with respect to the second pole section 30 of the pole unit 12.

Figure 6:
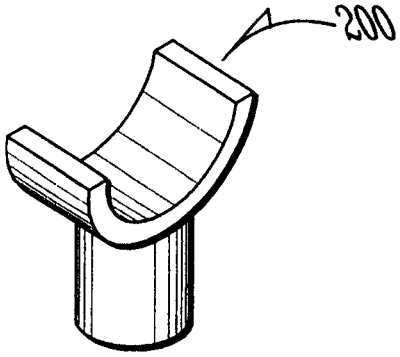
FIG. 6 is a perspective view of an alternative form of a workpiece-engaging unit.
Figure 7:
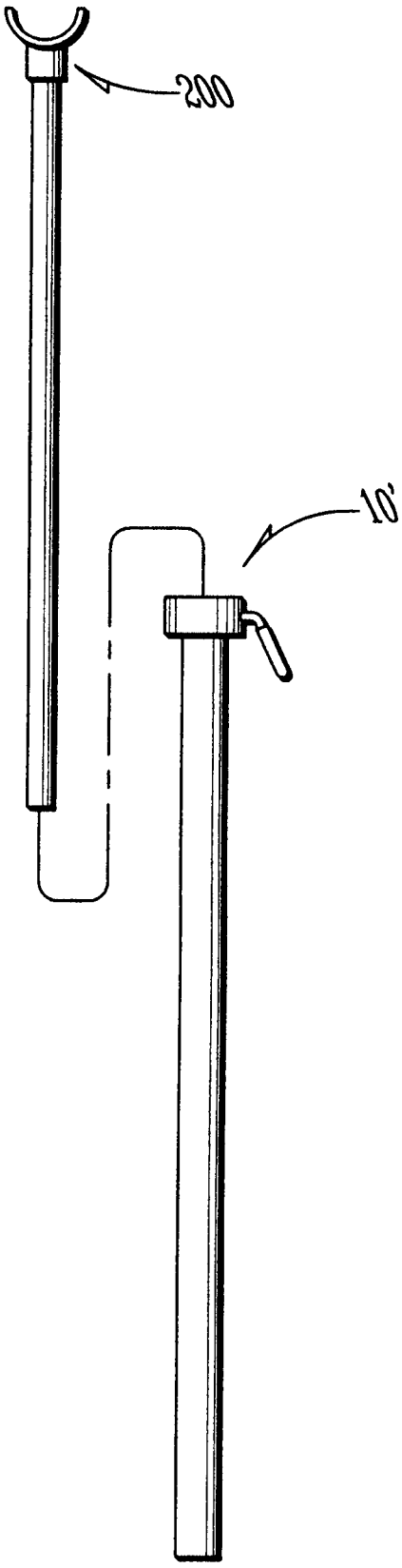
FIG. 7 is an exploded elevational view of a pole unit in association with the alternative form of workpiece-engaging unit.
Figure 8:
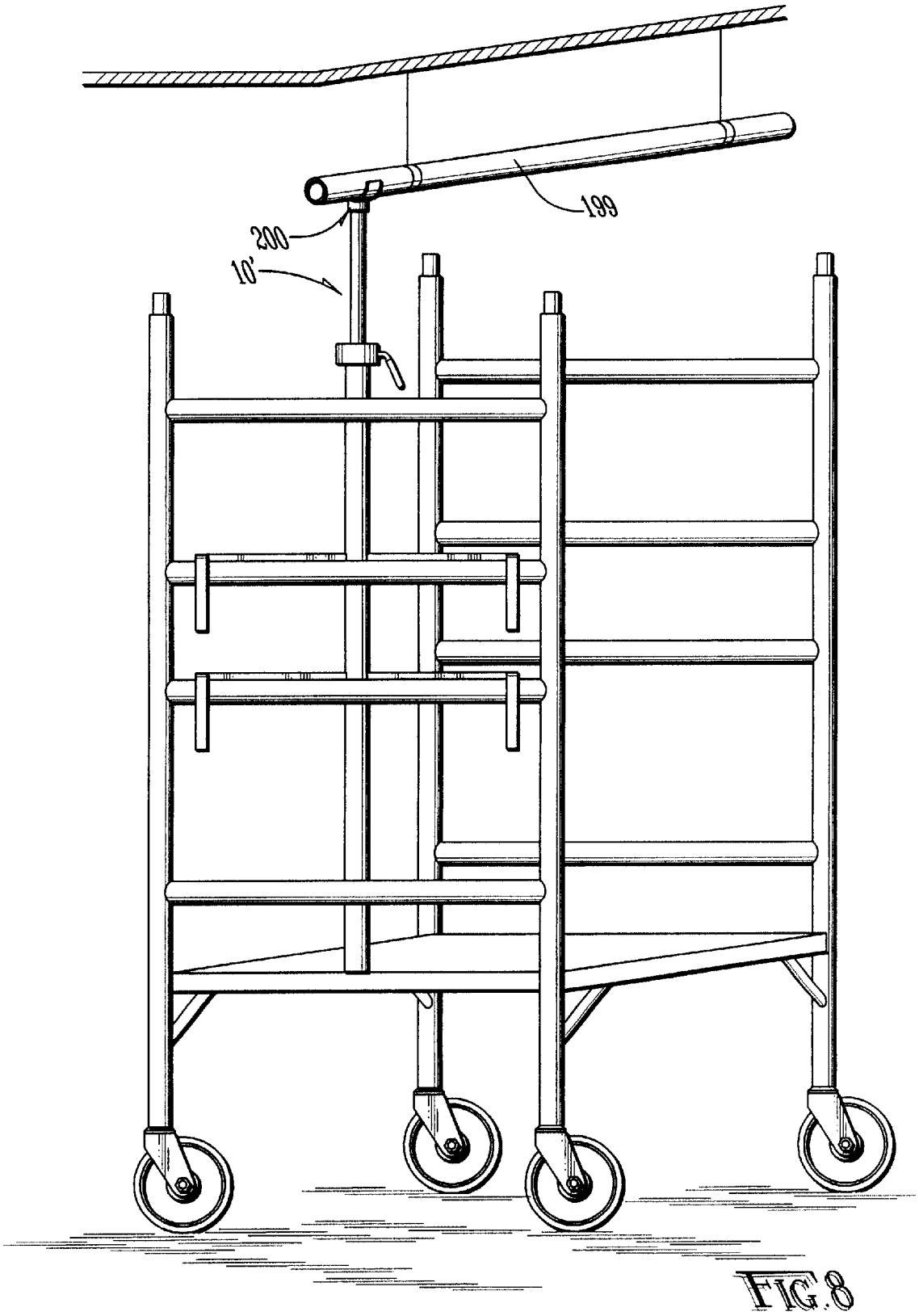
FIG. 8 is a perspective view of a scaffolding unit in association with an apparatus which includes the alternative workpiece-engaging unit.

An alternative form of the apparatus is used to elevate and support arcuate workpieces, such as conduit 199, or the like, while that arcuate workpiece is being attached to a ceiling or other such building structure or is simply being supported while such workpiece is being worked on. The alternative form of the apparatus is shown in FIGS. 6, 7 and 8, and is indicated as apparatus 10'. Apparatus 10' is identical to the above-described form with the exception that the workpiece-engaging element of the alternative form of the apparatus includes an arcuate workpiece-engaging member 200 fixedly mounted on the distal end of the support pole of said workpiece-engaging unit. The alternative form of the apparatus is shown in FIGS. 6, 7 and 8, which are similar to FIGS. 3, 4 and 5, to show the alternative form of the apparatus in a manner similar to the first form of the apparatus.

The apparatus can also be attached to scaffolding unit 98 by fasteners, such as bolts 202 shown in FIG. 5. The additional attachment provided by the fastener adds still further stability to the apparatus. One form of the scaffolding unit includes a workpiece holding unit 204 attached to the scaffolding unit, and the base pole section of the pole unit is attached to that workpiece-holding unit as shown in FIGS. 5 and 8 for the two forms of the apparatus. As shown in FIGS. 5 and 8, the workpiece holding unit supports workpieces, such as drywall panels $P_1$ in position for easy access by a worker standing on the scaffolding unit. As can also be seen in these figures, the scaffolding unit can have as many tiers as required for any particular job, and apparatus 10 can have as many supports as there are tiers. Thus, the apparatus can be easily and quickly modified without requiring modification of the scaffolding unit. In fact, the apparatus can be modified as easily and in conjunction with modification of the scaffolding unit itself in order to be customized for a particular job.

It is understood that while certain forms of the present invention have been illustrated and described herein, it is not to be limited to the specific forms or arrangements of parts described and shown.

We claim:

1. An apparatus for handling, lifting and supporting construction panels comprising:

a) a pole unit which includes (1) a base pole section having (A) a proximal end, (B) a distal end, (C) a cylindrical hollow body, (D) a longitudinal axis extending between the proximal end and the distal end of the base pole section, (E) a bore defined along the longitudinal axis from the distal end to the proximal end of the base pole section, (F) the bore of the body of the base pole section having an inner dimension, and (G) an outer surface, (2) a second pole section having (A) a proximal end, (B) a distal end, (C) a cylindrical hollow body, (D) a longitudinal axis extending between the proximal end of the second pole section of said pole unit and the distal end of the second pole section of said pole unit, (E) a bore defined along the longitudinal axis of the second pole section of said pole unit between the proximal end of the second pole section of said pole unit and the distal end of the second pole section of said pole unit, (F) the bore of the body of the second pole section of said pole unit having an inner dimension, and (G) the body of the second pole section of said pole unit having an outer surface with an outer dimension, the outer dimension of the second pole section of said pole unit being smaller than the inner dimension of the bore of the body of the base pole section of said pole unit, and (3) in a set-up configuration, the second pole section of said pole unit being telescopingly received in the bore of the body of the base pole section of said pole unit with the proximal end of the second pole section of said pole unit being located in the bore of the body of the base pole section of said pole unit, the distal end of the second pole section of said pole unit being spaced from the distal end of the base pole section of said pole unit;

b) a quick-release lock positioned on the body of the base pole section of said pole unit adjacent to the distal end of the base pole section of said pole unit and including
(1) a sleeve having
(A) a first section fixed to the outer surface of the base pole section of said pole unit,
(B) a second section spaced from the distal end of the base pole section of said pole unit,
(C) an inside surface, and
(D) an outside surface,
(2) a threaded bore defined through the sleeve in the second section of the sleeve, and
(3) a threaded fastener threadably received in the threaded bore of said quick-release lock, the threaded fastener having
(A) a distal end located adjacent to the inside surface of the sleeve,
(B) a proximal end located adjacent to the outside surface of the sleeve of said quick-release lock,
(C) a handle on the proximal end of the threaded fastener of said quick-release lock, and
(D) the threaded fastener being movable in the threaded bore between a locking position with the distal end of the threaded fastener engaging the outer surface of the second pole section of said pole unit received in the bore of the body of the base pole section of said pole unit in the set-up configuration and a releasing configuration with the distal end of the threaded fastener spaced from the outer surface of the second pole section of said pole unit received in the bore of the body of the base pole section of said pole unit in the set-up configuration;

c) a pole unit mounting section which includes
(1) two scaffolding engaging sections, each scaffolding engaging section being mounted on the base pole section of said pole unit near the proximal end of the base pole section and including
(a) a mounting element having
(i) a proximal end fixed to the outer surface of the base pole section of said pole unit, and
(ii) a distal end,
(b) a scaffolding engaging bracket which includes
(i) a U-shaped body which releasably engages an element of a scaffolding unit,
(ii) a first leg of the U-shaped body having a first end and a second end and a length defined between the first end of the first leg of the U-shaped body of the scaffolding engaging bracket and the second end of the first leg of the U-shaped body of the scaffolding engaging bracket,
(iii) a second leg of the U-shaped body having a first end and a second end and a length defined between the first end of the second leg of the U-shaped body of the scaffolding engaging bracket and the second end of the second leg of the U-shaped body of the scaffolding engaging bracket,
(iv) the length of the second leg of the U-shaped body of the scaffolding engaging unit being longer than the length of the first leg of the U-shaped body of the scaffolding engaging bracket,
(v) the first end of the first leg of the U-shaped body of the scaffolding engaging bracket being fixed to the mounting element of the pole unit mounting section adjacent to the distal end of the mounting element of the pole unit mounting section,
(vi) a bight section connecting the first end of the first leg of the U-shaped body of the scaffolding engaging bracket to the first end of the second leg of the U-shaped body of the scaffolding engaging bracket, and
(vii) the scaffolding engaging bracket extending away from the mounting element of the pole unit mounting section;

d) a workpiece-engaging unit which includes
(1) a support pole having an outer surface with an outer dimension which is smaller than the inner dimension of the bore of the body of the second pole section of said pole unit, the support pole of said workpiece-engaging unit having a distal end spaced from the distal end of the second pole section of said pole unit,
(2) a workpiece-engaging element fixed to the distal end of the support pole of said workpiece-engaging unit and including
(A) a tubular sleeve having a blind-ended bore,
(B) the support pole of said workpiece-engaging unit being received in the blind-ended bore of the tubular sleeve of the workpiece-engaging element and fixedly secured to the tubular sleeve adjacent to the blind-ended bore,
(C) the support pole of said workpiece-engaging unit being rotatably received in the bore of the second pole section adjacent to the distal end of the second pole section, and
(D) the workpiece-engaging element being rotatable in a plane that is at right angles to the plane containing the longitudinal axis of the second pole section of said pole unit, and
(E) two workpiece-engaging legs
(i) each workpiece-engaging leg having a proximal end fixed to the tubular sleeve of the workpiece-engaging element of said workpiece engaging unit,
(ii) each workpiece-engaging leg including a distal end spaced from the tubular sleeve of the workpiece-engaging element of said workpiece engaging unit,
(iii) the two workpiece-engaging legs being oriented at right angles with respect to each other, and
(iv) each workpiece engaging leg having a top edge, with the top edges of the workpiece-engaging legs being co-planar with each other; and e) a lock element positioned on the distal end of the second pole section of said pole unit and attaching the support pole of said workpiece-engaging unit to the second pole section of said pole unit in the set-up configuration, the lock element being movable between a locked configuration locking the support pole of the workpiece-engaging unit to the second pole section of said pole unit and an unlocked configuration in which the support pole of said workpiece-engaging unit is rotatable with respect to the second pole section of said pole unit.

2. The apparatus as described in claim 1 further including a second pole unit mounting section.

3. The apparatus as described in claim 2 further including a workpiece-holding unit attached to the scaffolding unit, the base pole section of said pole unit being attached to said workpiece-holding unit.

4. An apparatus for handling, lifting and supporting construction panels comprising:

a) a pole unit which includes (1) a base pole section having (A) a proximal end, (B) a distal end, (C) a cylindrical hollow body, (D) a longitudinal axis extending between the proximal end and the distal end of the base pole section, (E) a bore defined along the longitudinal axis from the distal end to the proximal end of the base pole section, (F) the bore of the body of the base pole section having an inner dimension, and (G) an outer surface, (2) a second pole section having (A) a proximal end, (B) a distal end, (C) a cylindrical hollow body, (D) a longitudinal axis extending between the proximal end of the second pole section of said pole unit and the distal end of the second pole section of said pole unit, (E) a bore defined along the longitudinal axis of the second pole section of said pole unit between the proximal end of the second pole section of said pole unit and the distal end of the second pole section of said pole unit, (F) the bore of the body of the second pole section of said pole unit having an inner dimension, and (G) the body of the second pole section of said pole unit having an outer surface with an outer dimension, the outer dimension of the second pole section of said pole unit being smaller than the inner dimension of the bore of the body of the base pole section of said pole unit, and (3) in a set-up configuration, the second pole section of said pole unit being telescopingly received in the bore of the body of the base pole section of said pole unit with the proximal end of the second pole section of said pole unit being located in the bore of the body of the base pole section of said pole unit, the distal end of the second pole section of said pole unit being spaced from the distal end of the base pole section of said pole unit;

b) a quick-release lock positioned on the body of the base pole section of said pole unit adjacent to the distal end of the base pole section of said pole unit and including (1) a sleeve having (A) a first section fixed to the outer surface of the base pole section of said pole unit, (B) a second section spaced from the distal end of the base pole section of said pole unit, (C) an inside surface, and (D) an outside surface, (2) a threaded bore defined through the sleeve in the second section of the sleeve, and (3) a threaded fastener threadably received in the threaded bore of said quick-release lock, the threaded fastener having (A) a distal end located adjacent to the inside surface of the sleeve, (B) a proximal end located adjacent to the outside surface of the sleeve of said quick-release lock, (C) a handle on the proximal end of the threaded fastener of said quick-release lock, and (D) the threaded fastener being movable in the threaded bore between a locking position with the distal end of the threaded fastener engaging the outer surface of the second pole section of said pole unit received in the bore of the body of the base pole section of said pole unit in the set-up configuration and a releasing configuration with the distal end of the threaded fastener spaced from the outer surface of the second pole section of said pole unit received in the bore of the body of the base pole section of said pole unit in the set-up configuration;

c) a pole unit mounting section which includes (1) two scaffolding engaging sections, each scaffolding engaging section being mounted on the base pole section of said pole unit near the proximal end of the base pole section and including (A) a mounting element having (i) a proximal end fixed to the outer surface of the base pole section of said pole unit, and (ii) a distal end, (B) a scaffolding engaging bracket which includes (i) a U-shaped body which releasably engages an element of a scaffolding unit, (ii) a first leg of the U-shaped body having a first end and a second end and a length defined between the first end of the first leg of the U-shaped body of the scaffolding engaging bracket and the second end of the first leg of the U-shaped body of the scaffolding engaging bracket, (iii) a second leg of the U-shaped body having a first end and a second end and a length defined between the first end of the second leg of the U-shaped body of the scaffolding engaging bracket and the second end of the second leg of the U-shaped body of the scaffolding engaging bracket, (iv) the length of the second leg of the U-shaped body of the scaffolding engaging unit being longer than the length of the first leg of the U-shaped body of the scaffolding engaging bracket, (v) the first end of the first leg of the U-shaped body of the scaffolding engaging bracket being fixed to the mounting element of the pole unit mounting section adjacent to the distal end of the mounting element of the pole unit mounting section, (vi) a bight section connecting the first end of the first leg of the U-shaped body of the scaffolding engaging bracket to the first end of the second leg of the U-shaped body of the scaffolding engaging bracket, and (vii) the scaffolding engaging bracket extending away from the mounting element of the pole unit mounting section;

d) a workpiece-engaging unit which includes (1) a support pole having an outer surface with an outer dimension which is smaller than the inner dimension of the bore of the body of the second pole section of said pole unit, the support pole of said workpiece-engaging unit having a distal end spaced from the distal end of the second pole section of said pole unit, (2) a workpiece-engaging element fixed to the distal end of the support pole of said workpiece-engaging unit and including (A) a tubular sleeve having a blind-ended bore, (B) the support pole of said workpiece-engaging unit being received in the blind-ended bore of the tubular sleeve of the workpiece-engaging element and fixedly secured to the tubular sleeve adjacent to the blind-ended bore, (C) the support pole of said workpiece-engaging unit being rotatably received in the bore of the second pole section adjacent to the distal end of the second pole section, and (D) the workpiece-engaging element being rotatable in a plane that is at right angles to the plane containing the longitudinal axis of the second pole section of said pole unit, (E) an arcuate workpiece-engaging member fixedly mounted on the distal end of the support pole of said workpiece-engaging unit; and e) a lock element positioned on the distal end of the second pole section of said pole unit and attaching the support pole of said workpiece-engaging unit to the second pole section of said pole unit in the set-up configuration, the lock element being movable between a locked configuration locking the support pole of the workpiece-engaging unit to the second pole section of said pole unit and an unlocked configuration in which the support pole of said workpiece-engaging unit is rotatable with respect to the second pole section of said pole unit.

5. The apparatus as described in claim 4 further including a second pole unit mounting section.

6. The apparatus as described in claim 5 further including a workpiece-holding unit attached to the scaffolding unit, the base pole section of said pole unit being attached to said workpiece-holding unit.

7. An apparatus for handling, lifting and supporting construction panels comprising:

a) a pole unit which includes a plurality of telescopingly engaged poles;

b) a quick-release lock coupling two of the poles of said pole unit together when in a locking configuration;

c) a pole unit mounting unit fixedly mounted on a first pole of said pole unit and including two scaffolding-engaging brackets having U-shaped bodies which releasably engage elements of a scaffolding unit;

d) a workpiece-engaging unit rotatably mounted on a second pole of said pole unit; and e) a lock element locking said workpiece-engaging unit to the second pole of said pole unit when in a locked configuration.

* * * * *